United States Patent [19]

Blundell

[11] Patent Number: 4,625,921

[45] Date of Patent: Dec. 2, 1986

[54] COMMINUTING

[75] Inventor: Brian F. Blundell, Ballinger, England

[73] Assignee: IMS Lycrete Limited, London, England

[21] Appl. No.: 719,670

[22] Filed: Apr. 4, 1985

[30] Foreign Application Priority Data

Jun. 4, 1984 [GB] United Kingdom ..... 8408936

[51] Int. Cl.[4] ..... B02L 17/14

[52] U.S. Cl. ..... 241/14; 241/30; 241/175; 241/284; 241/285 R

[58] Field of Search ..... 241/5, 14, 30, 175, 241/284, 285, 286, 101.7

[56] References Cited

U.S. PATENT DOCUMENTS 4,433,813 2/1984 Whatton et al. ..... 241/101.7 X

FOREIGN PATENT DOCUMENTS 633699 8/1936 Fed. Rep. of Germany ..... 241/175

*Primary Examiner*—Howard N. Goldberg
*Assistant Examiner*—Timothy V. Eley
*Attorney, Agent, or Firm*—Caesar, Rivise, Bernstein, Cohen & Pokotilow, Ltd.

[57] ABSTRACT

A comminuting apparatus operating on a dual mass system is designed to be compact and efficient. The apparatus comprises a frame (1, 2, 3; 31; 40) mounted on first springs (8) on a substrate (7). A processing vessel (4) is mounted on the frame and is connected thereto by second springs (6, 51). A motor (17) drives an imbalanced drive shaft (9) to cause vibration.

8 Claims, 8 Drawing Figures

COMMINUTING

(A) FIELD OF THE INVENTION

The invention relates to apparatus and method for use in comminuting material. The invention is of value in the treatment of material to be reduced to a predetermined size, e.g. cement, agricultural lime, or to separate by breaking of the mechanical bond the components of a bonded or agglomerated mixture of material e.g. to recover more valuable metallic fractions from steelworks scrap or slag material.

(B) PRIOR PATENTS

The comminuting apparatus of the invention is designed to operate by vibration and in particular by arranging the parts such that there is a dual mass system. Apparatus operating in this way is known, from U.S. Pat. No. 2760729, U.S. Pat. No. 3082965 and U.S. Pat. No. 3272443. Typically the industrially available apparatus is large and heavy, and it is customary to locate these apparatus on a substantial foundation to absorb the external vibration.

U.S. Pat. No. 3272443, Reiners, discloses apparatus for use in comminuting material to a predetermined size or to separate the components of an agglomerated material, comprising a processing vessel having an inlet and outlet for the material to be treated, means for applying a controlled periodic force to the vessel to cause vibration thereof, a first resilient means mounting the apparatus on a substrate, a second resilient means located about the vessel which is arranged to travel a substantially circular orbital path when energised by the force applying means. Specifically this patent discloses apparatus comprising a dual mass vibrator in which several milling vessels are held in parallel with the vessel ends being connected to box-like compartments in a common end frame. The compartments define the end walls of the vessels. In use, the apparatus is subjected to vibration, and the vessels travel in an orbit having an amplitude which is different from that undergone by the end frame. Because relative movement can take place between the body of a vessel and the end walls defined by the frame undue wear will take place and the apparatus cannot be operated successfully over a prolonged period. Sleeved springs, optionally precompressed, are present adjacent the compartments but such springs are likely to suffer from overheating which would shorten their life. The mill incorporates a cooling system. Also the stiffness of the sleeved springs cannot be controlled.

(C) OBJECT OF INVENTION

It is one object of the invention to provide apparatus operating as a dual mass system for use in comminuting materials which will realise all the potential advantages of such a system and be compact, i.e. of low volume and so built at a low capital cost, will have a long useful life, will operate at near resonance without generating unacceptable external forces so that a substantial foundation is not required to support the apparatus, and will operate a high rate of throughput and apply intensive input energy to the charge of material to be comminuted.

SUMMARY OF THE INVENTON

The problem solved by this invention is to provide a dual mass apparatus which has the features described as the object of this invention. This problem is solved, according to the invention, by arranging that the controlled periodic force is applied to the second resilient means via a frame which is separate from the second resilient means and from the vessel.

Because the frame and the second spring means and the vessel are independent, the parts may be run at high speed without the risk of damage, wear, separation or the like. The second resilient means is preferably arranged so that the spring elements are disposed symmetrically radially about the vessel so that stiffness in any given direction is constant and the elements travel in a circular orbit. The stiffness of the second resilient means is arranged to provide the required amplitude of movement of the vessel and the provision of a high concentration of power into the vessel, while not imposing undue stresses in the other parts of the apparatus.

It will be noted that there are two independent resilient systems. The means may be the same in both systems or they may be different but the first resilient means supporting the frame need only have sufficient stiffness to support the dead weight of the remainder of the apparatus whereas the second resilient means must have a degree of stiffness to direct the vibration towards the processing vessel. Preferably the second resilient means are heat tolerant springs, e.g. carbon or carbon alloy spring elements, held in an annular ring at least adjacent the ends of the vessel, and these are precompressed to an appropriate degree of stiffness. Most preferably, the second resilient spring means has a relatively high degree of stiffness such that it is able to absorb energy generated by the vibration and return it to the vessel. Not all forms of spring will have the required level of stiffness for example because of heat generated in use it is preferred not to use air bellows or rubber blocks when treating material having a high energy input. Because of the friction generated, leaf springs should be avoided.

It is an important feature of this invention that the controlled periodic force is applied directly to the frame which is independent from the vessel and from the second resilient means. The power means may comprise a pair of imbalanced drive shafts arranged to apply a vibrational force about an axis substantially parallel to the longitudinal axis of the vessel, or it may comprise an out of balance motor. In each case the vibration is arranged to cause the vessel to travel a substantially circular rotational path.

Because the apparatus is so efficient, the vessel can be small, e.g. up to one or two meters long. The apparatus may include a plurality of vessels and these may be arranged vertically one above another or in a horizontal bank. The material may be fed from one vessel to another, each performihg a separate treatment, e.g. grinding to a different size, or the same treatment may be performed in each vessel.

The apparatus may include other parts known in mills such as screens, classifiers, air separators, recirculation equipment, etc.

The vessel will typically contain a grinding medium or aid. This may take a variety of forms, ranging from rods or balls, dependent on the material being treated and the intended end result. In another embodiment, the material to be milled may be used on its own, the particles being self crushing under the vibration milling.

According to another aspect of the invention, there is a method of comminuting material using the apparatus defined above, comprising placing the material in the vessel, and applying a controlled periodic force to the apparatus to cause the vessel to travel a substantially circular orbital path, preferably at a speed exceeding 150 rad/sec and at an amplitude exceeding 3 mm radius until such time as the material has been comminuted to a predetermined extent.

The running speed and the amplitude of the substantially circular rotational motion may be varied according to the use of the apparatus. Where impacting is required, as in upgrading, the speed will be relatively moderate and the amplitude high whereas for fine milling the speed will be high and the amplitude moderate.

Apparatus of the invention may be run at speeds of say 200 to 243 rad/sec. (2000 to 2430 revolution/minute) instead of the more usual 100 rad/sec.

Because of the relative stiffness of the first and second resilient means and the relative positions of the centre of gravity of the processing vessel and the drive means, the vessel will travel a substantially circular orbital path and this, coupled with the operation of the apparatus by virtue of a high speed and amplitude of vibration generating operation near resonance causes an intensive energy input on to the charge in the processing vessel while at the same time avoiding the generation of external vibration to the substrate and the need for a large volume vessel. There is little or no need to embed the apparatus in a vibration resistant body of e.g. concrete. Indeed the apparatus of the invention is sufficiently compact and free of external vibration to be transportable, e.g. mounted on a trailer.

The invention is useful in the treatment of a variety of materials. For example, it may be used to upgrade the scrap portion of iron and steel slags, mill iron and steel slag, produce fertilizer by the grinding of LDAC slag, or prepare stainless steel slags for use in cement manufacture, or in grinding of general chemicals and ores generally. The materials may be treated while dry or wet.

In order that the invention may be well understood it will now be described by way of example only with reference to the accompanying diagrammatic drawings, in which:

(E) BRIEF DESCRIPTION OF DRAWING

Where possible the same reference numbers are used to describe the different embodiments.

(F) DESCRIPTION OF PREFERRED EMBODIMENTS

Figure 1:
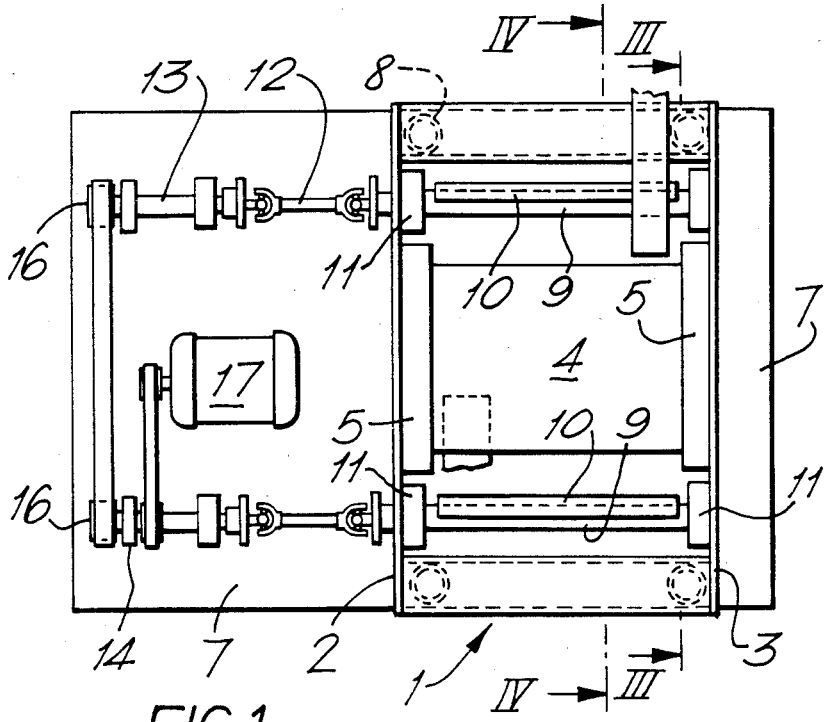
FIG. 1 is a top plan view of one apparatus of the invention.
Figure 2:
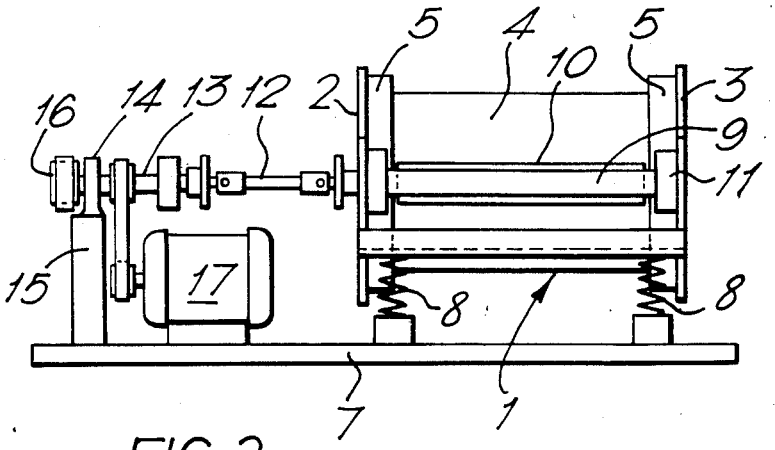
FIG. 2 is a side elevation of the apparatus of FIG. 1.

The apparatus of FIGS. 1 to 4 comprises a horizontal frame 1 having two end walls 2,3 spaced about 1 or 2 meters apart. A vessel 4 comprising a processing chamber is supported at each end on a separate frame 1 on a ring 5 of high total strength rubber springs 6, shown in more detail in FIG. 3. The vessel has at each end an end wall which is welded or otherwise secured to the vessel body. The frame 1 is itself supported on a table-like base substrate 7 by springs 8 placed one in each corner. On each side of the chamber 4 is a drive shaft 9 having off balance weights 10,the shafts being mounted in suitable bearings 11.

Figure 4:
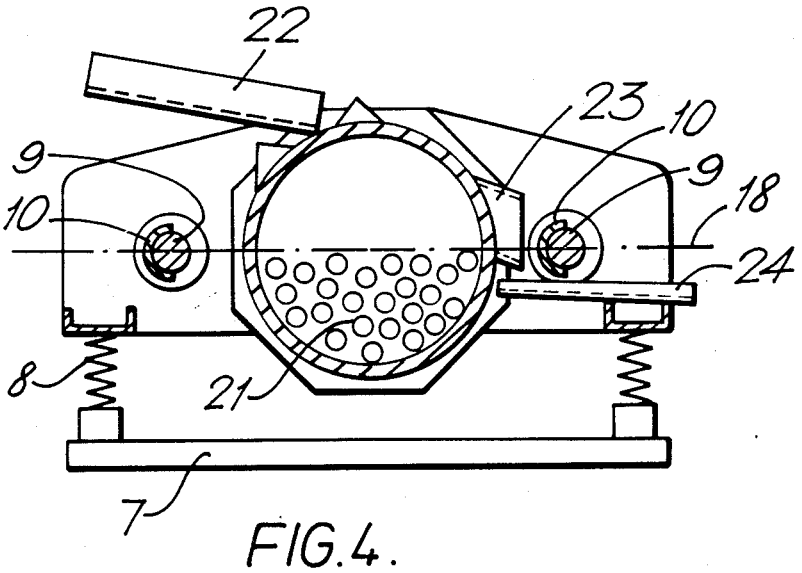
FIG. 4 is a partial sectional view taken on lines IV—IV on FIG. 1.

The shafts 9 are connected to universally jointed shafts 12 and in turn to shafts 13 mounted in bearings 14 carried on uprights 15 on the frame 7. The ends of the shafts 13 are connected by timing belts on gears 16, and the whole shaft system is driven by a motor 17 driving one or both shafts via belts or gears of suitable size. The axis of the shafts 9 and the processing chamber 4 lie on a common horizontal centre line 18 (FIG. 4).

Figure 3:
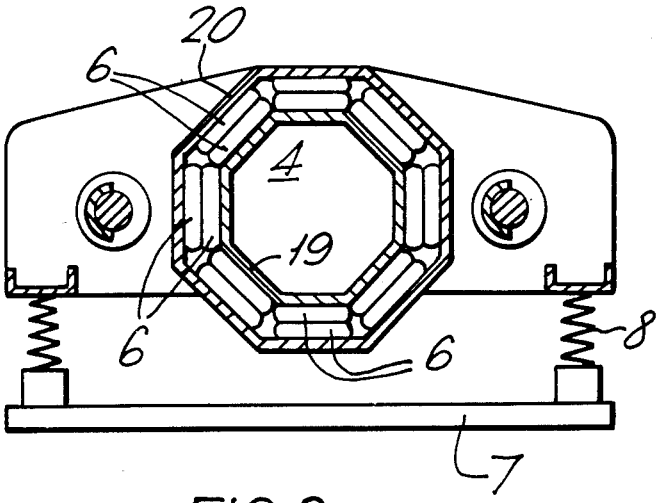
FIG. 3 is a partial sectional view taken on lines III—III on FIG. 1.

As shown in FIG. 3, an inner frame 19 is secured to each end of the processing chamber 4, and supports rubber or polymer compression mountings 6 spaced equally around the frame 19. The mountings are precompressed to an amount at least equal to the maximum operating amplitude of the processing chamber, between the inner frame 19 and an outer frame 20 which forms part of the end wall of the frame 1. Other suitable high strength springs may be used.

The processing chamber will typically contain a grinding aid 21 such as rods or balls, and may typically be charged with ore via a feeder 22 forming part of the frame 1, and the crushed ore may discharge via an aperture 23 in the process chamber 4, and a second chute 24 forming part of the frame 1. Adjustment of the angles of feeder 22 and chute 24 relative to the support 1 may be provided by conventional means to control the rate of throughput of the ore.

In use, the motor is energised and the apparatus is run such that the speed of revolution of the drive shafts 9 is about 204 rad/sec and the amplitude of rotation of the vessel 4 is at least 3 mm. Material fed into the vessel is subjected to high impact forces, as the vibration forces are directed towards the vessel, and as a result the material is ground or milled at a fast rate with little or no external vibration.

Figure 5:
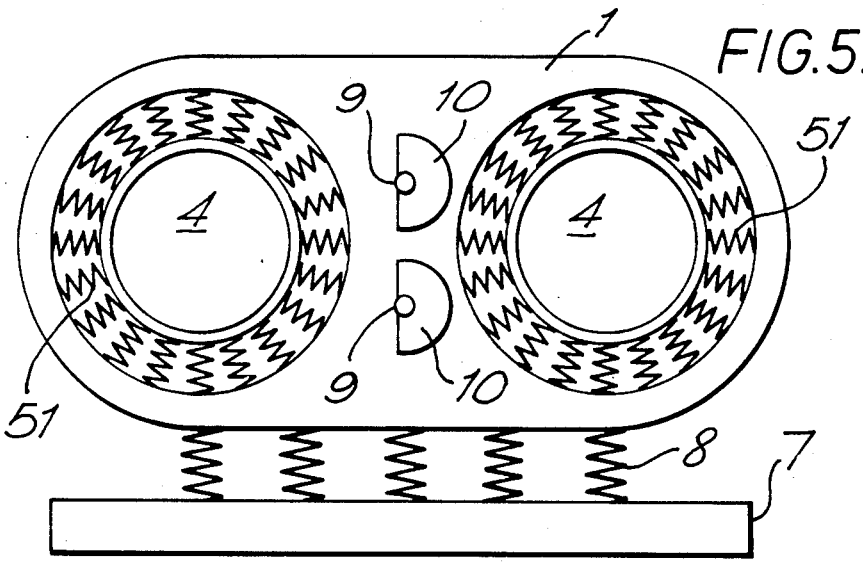
FIG. 5 is an end view of another apparatus.
Figure 6:
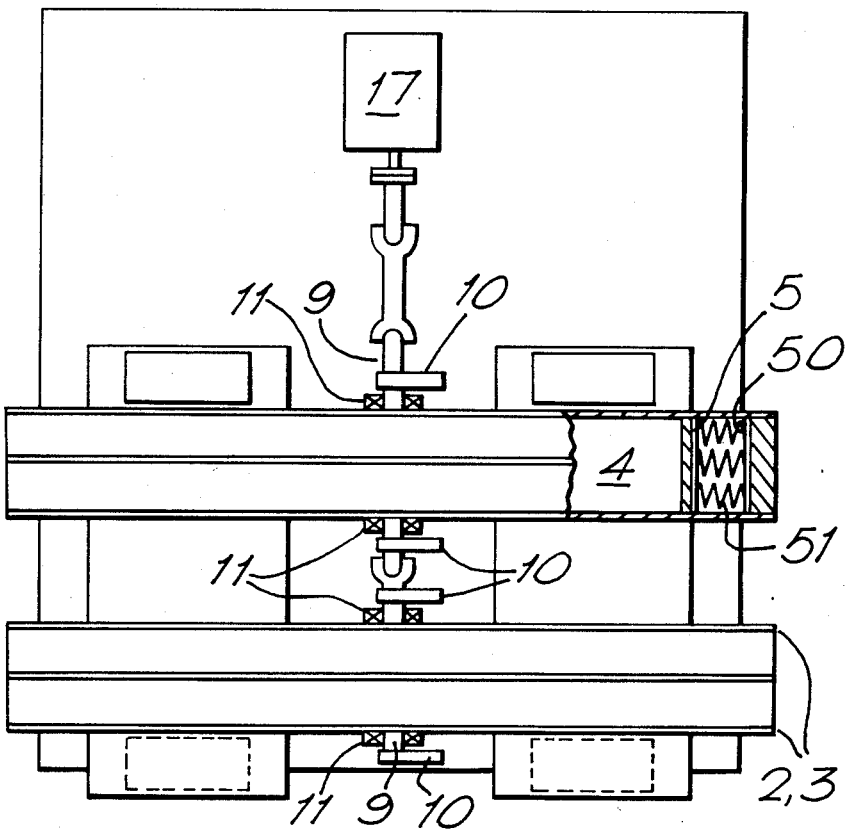
FIG. 6 is a plan view, partly in section, of the apparatus of FIG. 5.

The embodiment of FIGS. 5 and 6 comprises a pair of parallel vessels or processing chambers 4 mounted on a common frame 1. The ends of the vessels are closed by end walls. A pair of drive shafts 9 carrying eccentric weights 10 is present between the vessel 4. The ends of the vessels are received loosely within a polygonal ring 5 formed of steel plates 50 welded together. The ring houses a row, of radially arranged, steel coil springs, 51, biased between the inner and outer walls of the ring. Two or more rows of such springs may be present. Bearings 11 are fixed to the end walls 2, 3, behind the rings 5.

In operation, as the drive shafts 9 rotate, the eccentric weights 10 cause the frame 1 to vibrate. This is transmitted to the vessels 4 which vibrate in a circular orbital path, the ends of the vessel moving within the rings 5. The frame 1 is supported on the springs 8, and little or no vibration is transmitted to the substrate 7.

Figure 7:
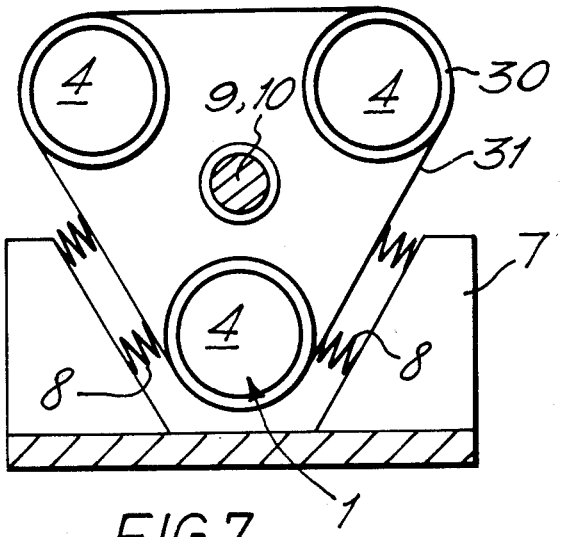
FIG. 7 is an end view of another apparatus of the invention.

FIG. 7 shows in diagrammatic form apparatus of the invention wherein a multiple of processing chambers 4 are carried on high strength springs 30 attached to a common support frame 31. Frame 31 is supported via springs 8 on a base 7 and carries a single or multiple of drive shafts 9 having off-balance weights 10. The chambers 4 are disposed relative to the drive shafts so as to be in static balance about the drive shaft.

Figure 8:
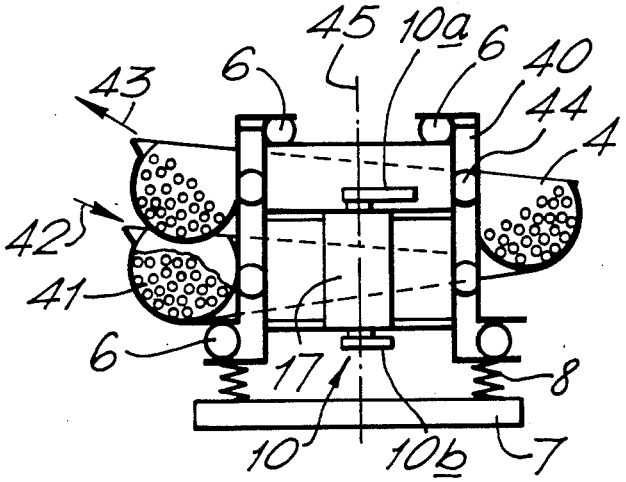
FIG. 8 is a vertical sectional view of another apparatus of the invention.

In the embodiment of FIG. 8, the vessel or processing chamber 4 has the configuration of an annular trough or spiral formed on a vertical cylinder 40 such that ore 41 or other material to be ground can be fed continuously at position 42 and migrate during grinding inside the trough 4 to be discharged at an outlet position 43. The cylinder 40 is suspended on a second tube 44 via high strength springs 6 which are suitably disposed. The second tube 44 carries on its vertical axis 45 a motor 17 having off-balance weights 10 at each end. The weights 10*a* are normally angularly displaced relative to the weights 10*b* to induce a suitable movement in the tubes thereby causing the ore 41 to rotate within the trough 4 as well as migrate as described before. The tube 44 is carried on a fixed frame 7 via springs 8.

In order that the invention may be well understood it will now be illustrated with reference to the following Examples, which relate to the upgrading of steel works scrap and the grinding of material to meet the EEC standard for fertilizer.

EXAMPLE 1

50 kg of steelworks slag of size range 0 to 15 mm and containing 48% Fe was crushed with a charge of 50 mm diameter rods in a mill according to the invention and run at a speed of 204 rad/sec with an amplitude of 4.5 mm and for a duration of 60 seconds. The product was subjected to magnetic separation and yielded 22 kg of 80% Fe average iron content. This may be used directly in steel making. In contrast, when the starting metal was subjected to magnetic separation in the absence of milling, the yield was 23 kg of 70% Fe average iron content.

EXAMPLE 2

A 75 kg sample of LDAC steel slag was ground using a charge of 50 mm diameter rods, and the mill was run at a speed of 204 rad/sec at an amplitude of 3 mm. The process chamber volume was $0.125m^3$.

The sample was ground for 90 seconds equivalent to a continuous rate of 3 T/hr. The product contained 44% passing 200 micron, equivalent to 1.65 T/hr of 80% passing 200 micron.

The grinding index of the slag was 16.5 Kw-hr/T.

The specific process rate (SPR) (Tonne per hour per unit volume of process chamber to produce powder containing 80% passing 200 micron sieve size from 80% passing 20 millimeter sieve size) was 13.2 $T/hrm^3$.

For comparison, tests made with a rotary ball mill, and with a single mass vibrator gave typically:

| | |
|---|---|
| Ball Mill | SPR = 0.697 $T/hrm^3$ |
| Conventional Vibrator | SPR = 2.45 $T/hrm^3$ |
| (At 104 rad/sec × 5 mm amplitude). | |

EXAMPLE 3

An embodiment of apparatus was built according to FIGS. 5 and 6 including as the second springs 51 carbon steel springs of a relatively high degree of stiffness. The springs were precompressed on assembly.

The waste slag from the floor area under a steel converter (projection) sized 6 to 50 mm and containing about 40% Fe was processed in the apparatus at 1500 rpm and an amplitude of 7.5 mm, at the rate of 6 tonne/-hour. The material was recovered and screened and separated to provide 90% Fe, and lime which could be used directly for agricultural processes.

I claim:

1. A method of comminuting material to a predetermined size, said method comprising using apparatus which includes a frame; first resilient means carried by said frame and adapted for mounting said apparatus on a substrate; a processing vessel carried by said frame and having an inlet and an outlet for said material to be processed; second resilient means comprising a plurality of spring members mounted about said vessel between said vessel and said frame, said second resilient means being independent of said vessel and said frame; and means to apply a controlled periodic force to said frame thereby to cause vibration of said frame and said vessel, wherein, material is placed in said processing vessel and said controlled periodic force is then applied to said frame to cause the material in said vessel to travel a substantially circular orbital path.

2. The method of claim 1 wherein the material in said vessel travels in a substantially circular orbital path at a speed exceeding 1500 revolutions/minute and at an amplitude exceeding 3 mm radius.

3. The method of claim 1 which results in the separation of the components of an agglomerated material.

4. Apparatus for use in comminuting material to a predetermined size or in separating the components of an agglomerated material, comprising a frame; first resilient means carried by said frame and adapted for mounting said apparatus on a substrate; a processing vessel carried by said frame and having an inlet and an outlet for said material to be processed; second resilient means comprising a plurality of spring members mounted about said vessel between said vessel and said frame, said second resilient means being independent of said vessel and said frame; and means to apply a controlled periodic force to said frame relative to the substrate, thereby to cause vibration of said frame and said vessel with the material within the vessel rotating in a substantially circular orbital path relative to said frame.

5. Apparatus as claimed in claim 4 in which said spring members are compression springs.

6. Apparatus as claimed in claim 5 in which said spring members are precompressed.

7. Apparatus as claimed in claim 4 wherein two plurralities of said spring members are mounted about the two ends of said vessel respectively.

8. Apparatus as claimed in claim 4 in which said means to apply a controlled periodic force to said frame comprises a pair of inbalanced drive shafts coupled to said frame and extending substantially parallel to the longitudinal axis of said vessel.

* * * * *